US008047388B2

(12) United States Patent
Kelley et al.

(10) Patent No.: US 8,047,388 B2
(45) Date of Patent: Nov. 1, 2011

(54) PLASTIC CONTAINER HAVING A DEEP-INSET BASE

(75) Inventors: Paul V. Kelley, Wrightsville, PA (US); Scott E. Bysick, Elizabethtown, PA (US); Brian A. Lynch, Merrimack, NH (US); Thomas E. Nahill, Amherst, NH (US); Romuald Philippe, York, PA (US)

(73) Assignee: Graham Packaging Company, L.P., York, PA (US)

( * ) Notice: Subject to any disclaimer, the term of this patent is extended or adjusted under 35 U.S.C. 154(b) by 229 days.

(21) Appl. No.: 12/329,912

(22) Filed: Dec. 8, 2008

(65) Prior Publication Data

US 2010/0140278 A1 Jun. 10, 2010

(51) Int. Cl.
*B65D 1/42* (2006.01)

(52) U.S. Cl. ..... 215/373; 220/608

(58) Field of Classification Search ..... 215/373; 220/606, 608

See application file for complete search history.

(56) References Cited

U.S. PATENT DOCUMENTS

| | | | | | |
|---|---|---|---|---|---|
| 3,843,005 | A | * | 10/1974 | Uhlig | 215/373 |
| 3,973,693 | A | * | 8/1976 | Brocklehurst | 220/604 |
| 4,035,455 | A | | 7/1977 | Rosenkranz et al. | |
| 4,177,239 | A | | 12/1979 | Gittner et al. | |
| 4,318,882 | A | | 3/1982 | Agrawal et al. | |
| 4,465,199 | A | | 8/1984 | Aoki | |
| 4,585,158 | A | | 4/1986 | Wardlaw, III | |
| 4,894,268 | A | * | 1/1990 | Greenwood et al. | 428/36.92 |
| 5,066,081 | A | * | 11/1991 | Bartley et al. | 215/373 |
| 5,244,106 | A | | 9/1993 | Takacs | |
| 5,989,661 | A | | 11/1999 | Krishnakumar et al. | |
| 6,113,377 | A | | 9/2000 | Clark | |
| 6,277,321 | B1 | | 8/2001 | Vailliencourt et al. | |
| 6,372,318 | B1 | | 4/2002 | Collette et al. | |
| 6,595,380 | B2 | | 7/2003 | Silvers | |
| 6,942,116 | B2 | | 9/2005 | Lisch et al. | |
| 7,150,372 | B2 | | 12/2006 | Lisch et al. | |
| 2002/0153343 | A1 | * | 10/2002 | Tobias et al. | 215/375 |
| 2003/0116525 | A1 | * | 6/2003 | Futral et al. | 215/373 |
| 2006/0060554 | A1 | | 3/2006 | Garman | |
| 2007/0084821 | A1 | | 4/2007 | Bysick et al. | |
| 2008/0047964 | A1 | | 2/2008 | Denner et al. | |

FOREIGN PATENT DOCUMENTS

| | | | |
|---|---|---|---|
| EP | 0995687 | | 4/2000 |
| JP | 06-027522 | | 4/1994 |
| JP | 09-240651 | | 9/1997 |
| WO | WO 8805747 | A2 * | 8/1988 |
| WO | 90/06263 | | 6/1990 |
| WO | 92/20587 | | 11/1992 |

OTHER PUBLICATIONS

PCT International Search Report dated Feb. 2, 2010.

* cited by examiner

*Primary Examiner* — Sue Weaver
(74) *Attorney, Agent, or Firm* — Knoble Yoshida & Dunleavy, LLC

(57) ABSTRACT

A plastic container of the type that may be formed from a material such as PET using the stretch blow molding process includes a main body portion and a base portion that is characterized by a relatively tall and narrow profile above the standing ring and that has a deep inset recess defined therein. The deep inset recess is defined in part by an upstanding inner sidewall portion adjacent to the standing ring that has a height that may be greater than about 0.35 inch. The upstanding inner sidewall portion may have a substantially straight portion that is substantially parallel to a substantially straight portion of an outer sidewall of the base.

10 Claims, 7 Drawing Sheets

PLASTIC CONTAINER HAVING A DEEP-INSET BASE

BACKGROUND OF THE INVENTION

1. Field of the Invention

This invention relates generally to the design and manufacture of plastic containers, particularly plastic containers that are made by the reheat stretch blow molding process.

2. Description of the Related Technology

Plastic containers for packaging beverages are commonly fabricated from polyesters such as polyethylene terephthalate (PET). PET containers are lightweight, inexpensive, and recyclable and can be economically manufactured in large quantities.

PET containers are typically manufactured using the stretch blow molding process. This involves the use of a preform that is injection molded into a shape that facilitates distribution of the plastic material within the preform into the desired final shape of the container. The preform is first heated and then is longitudinally stretched and subsequently inflated within a mold cavity so that it assumes the desired final shape of the container. As the preform is inflated, it takes on the shape of the mold cavity. The polymer solidifies after contacting the cooler surface of the mold, and the finished hollow container is subsequently ejected from the mold.

PET containers are common for use in packaging beverages such as juices using what is known in the industry as the hot-fill process. This involves filling the containers while the liquid product is at an elevated temperature, typically 68° C.-96° C. (155° F.-205° F.) and usually about 85° C. (185° F.) in order to sterilize the container at the time of filling. Containers that are designed to withstand the process are known as "hot fill" type containers. After filling, such containers undergo significant volumetric shrinkage as a result of the cooling of the product within the sealed container. Hot fill type containers accordingly must be designed to have the capability of accommodating such shrinkage. Typically this has been done by incorporating one or more concave vacuum panels into the side wall of the container that are designed to flex inwardly as the volume of the product within the container decreases as a result of cooling. More recently, it has been proposed to accommodate such volumetric shrinkage by providing a movable vacuum panel in the bottom of the container.

In some instances, it is desirable for a plastic container to be formed with a deep inset base, i.e. a base that is shaped to have a relatively tall and narrow standing ring. A deep inset base may be desirable for any one of a number of different reasons, including but not limited to the placement of a movable vacuum panel in the bottom of the container. For example, a manufacturer may desire to place an article in the space that is defined by the container bottom, or a deep inset base may be desirable in order to provide stackability of the containers with respect to each other.

Unfortunately, it has been problematic in the past to manufacture a container having a deep inset base using the reheat stretch blowmolding process. Efforts to produce such containers often resulted in unwanted extreme stretching and thinning of the container wall in the area of the standing ring of the container base, crimping or folding of the standing ring, or other unwanted deformities in the bottom of the container. These problems made it practically impossible to effectively for a container having a deep inset base. A need exists for an improved container having a deep inset base and an improved method for manufacturing such a container.

SUMMARY OF THE INVENTION

Accordingly, it is an object of the invention to provide an improved container having a deep inset base and an improved method for manufacturing such a container.

In order to achieve the above and other objects of the invention, a plastic container according to one aspect of the invention includes a main body portion and a base portion that defines a standing ring and that has a deep inset recess defined therein. The deep inset recess is defined in part by an upstanding sidewall portion that is adjacent to the standing ring that has a height that is greater than about 0.35 inch.

According to a second aspect of the invention, a plastic container includes a main body portion and a base portion having a deep inset recess defined therein, the deep inset recess being defined in part by an upstanding inner sidewall portion having a substantially straight portion as viewed in longitudinal cross-section. The base portion further includes an outer sidewall having a substantially straight portion. The substantially straight portion of the upstanding inner sidewall portion is advantageously substantially parallel to the substantially straight portion of the outer sidewall.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
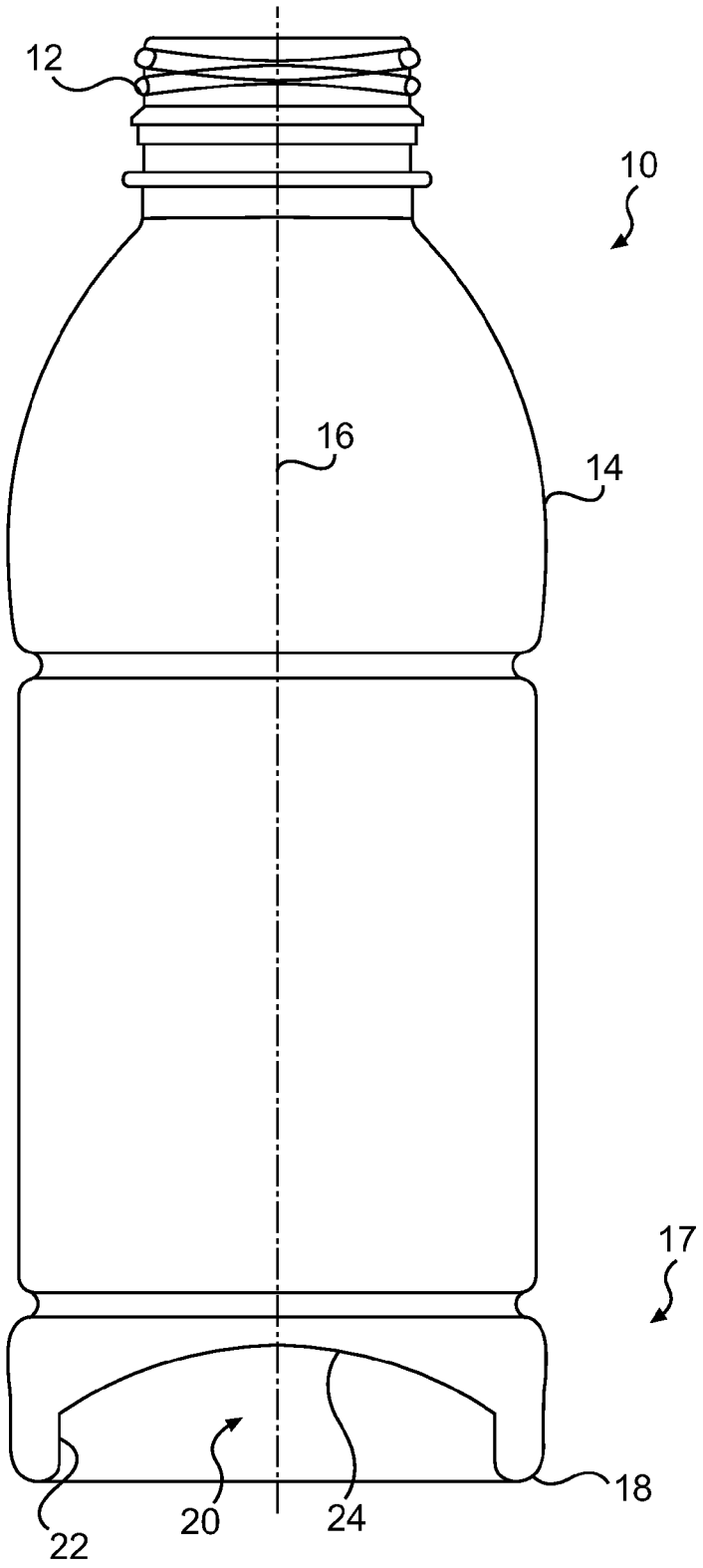
FIG. 1 is a diagrammatical view depicting a container that is made according to a first preferred embodiment of the invention in vertical cross-section.

Referring now to the drawings, wherein like reference numerals designate corresponding structure throughout the views, and referring in particular to FIG. 1, a plastic container 10 that is constructed according to a first preferred embodiment of the invention is preferably fabricated using the well-known reheat stretch blow molding process out of a material such as PET.

Plastic container 10 includes a threaded finish portion 12 to which a closure may be attached in conventional fashion, a main body portion 14 that is preferably substantially symmetrical about a vertical axis 16 and a container bottom 17 that is shaped so as to define a standing ring 18 for supporting the container 10 on a relatively flat underlying surface. In the preferred embodiment, the standing ring 18 is constructed as a continuous annular surface, but could alternatively be constructed as a plurality of downwardly depending feet, each having a lower surface for supporting the container 10 on an underlying surface.

Figure 4:
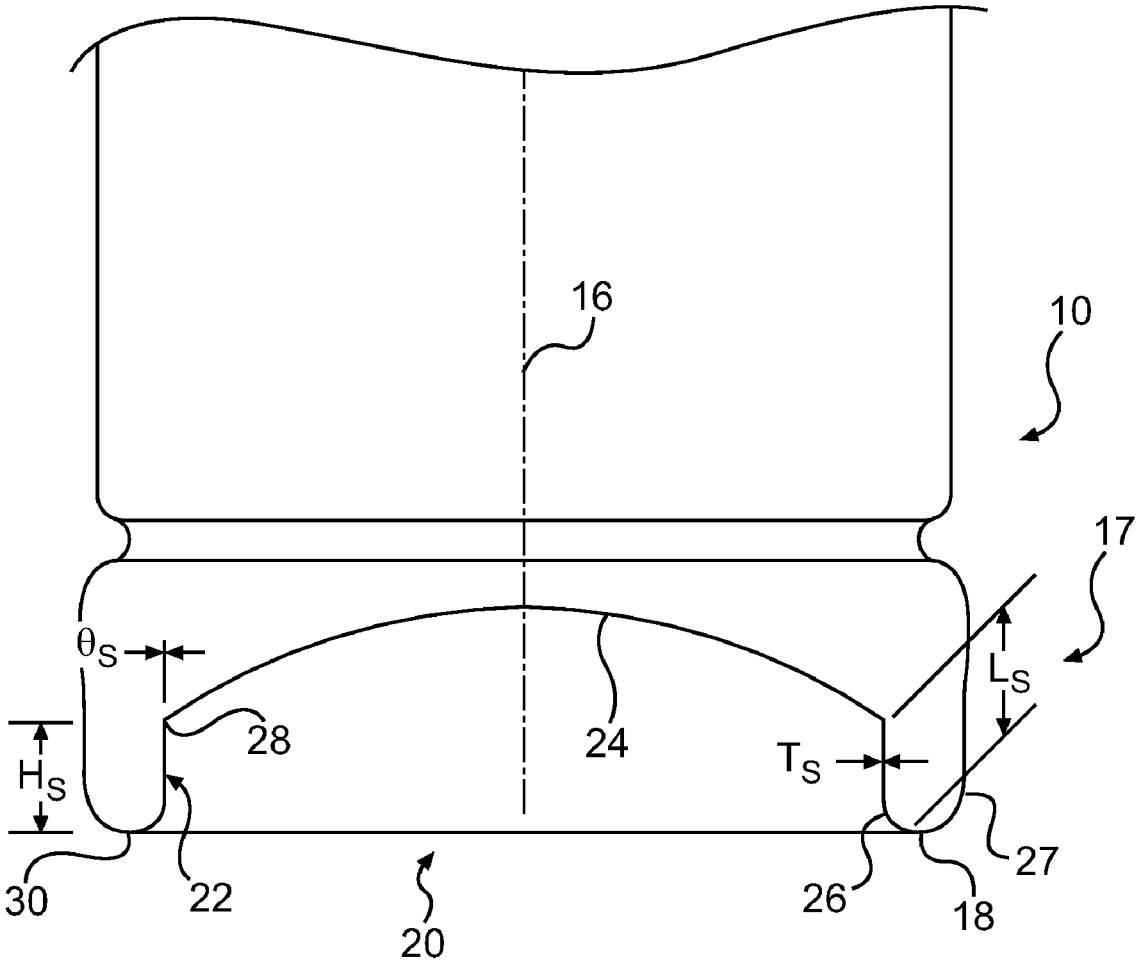
FIG. 4 is an enlarged view of a portion of the article that is depicted in FIG. 1.

As is best shown in FIG. 4, the container bottom 17 includes a central push-up area 20 that is positioned radially inwardly of the standing ring 18 so as to form a deep inset recessed base portion having relatively tall and narrow profile immediately above the standing ring 18.

The central push-up area 20 is defined in part by an upstanding container bottom sidewall portion 22 that in the preferred embodiment defines a continuous inwardly facing annular ring. The upstanding container bottom sidewall portion 22 is preferably although not necessarily substantially smooth and preferably includes a substantially linear portion when viewed in longitudinal cross-section. It may have a plurality of spaced ribs or grooves, which preferably are longitudinally or vertically oriented, which facilitate separation from the blow mold cavity wall.

The central push-up area 20 is also defined in part by a central portion 24, which may be shaped conventionally according to any one of a number of known configurations, the details of which are not essential to a full understanding of the invention.

Preferably, the upstanding container bottom sidewall portion 22 has a height $H_S$ as measured parallel to a longitudinal axis 16 of the container that is greater than about 0.35 inch, and that is more preferably within a range of about 0.35 inch to about 1.2 inch. The substantially smooth upstanding container bottom sidewall portion 22 also has a length $L_S$ that is defined as the surface distance between a top portion 28 and a bottom portion 30 as viewed in vertical cross-section as shown in FIG. 4. Preferably, the length $L_S$ is within a range of about 100% to about 115% of the height $H_S$.

Preferably, the upstanding container bottom sidewall portion 22 is immediately adjacent to the standing ring 18 of the container 10. In the preferred embodiment, the upstanding container bottom sidewall portion 22 is unitary at its lowermost end with the surface that defines the standing ring 18 of the container 10. Standing ring is this context is defined as the lowermost surface of the container 10 that contacts an underlying flat horizontal surface when the container 10 is placed thereon.

Looking again to FIG. 4, it will be seen that the upstanding container bottom sidewall portion 22 includes a substantially straight portion 26 that is angled with respect to a vertical plane that is parallel to the vertical axis 16 of the container 10 at an angle $\Theta_S$ that is preferably within a range of about 0° to about 15°. In the embodiment of FIG. 4, angle $\Theta_S$ is shown as about 0°.

The substantially straight portion 26 is also preferably substantially parallel to a substantially straight portion 27 of an outer sidewall of the container bottom 17, which facilitates the formation of a deep inset base having a relatively tall narrow standing ring. "Substantially parallel" for purposes of this feature is defined as within an angle range of about 0° to about 20°.

Preferably, the substantially smooth upstanding container bottom sidewall portion 22 has an average wall thickness $T_S$ that is within a range of about 0.018 inch to about 0.011 inch, and that is most preferably about 0.014 inch.

Figure 5:
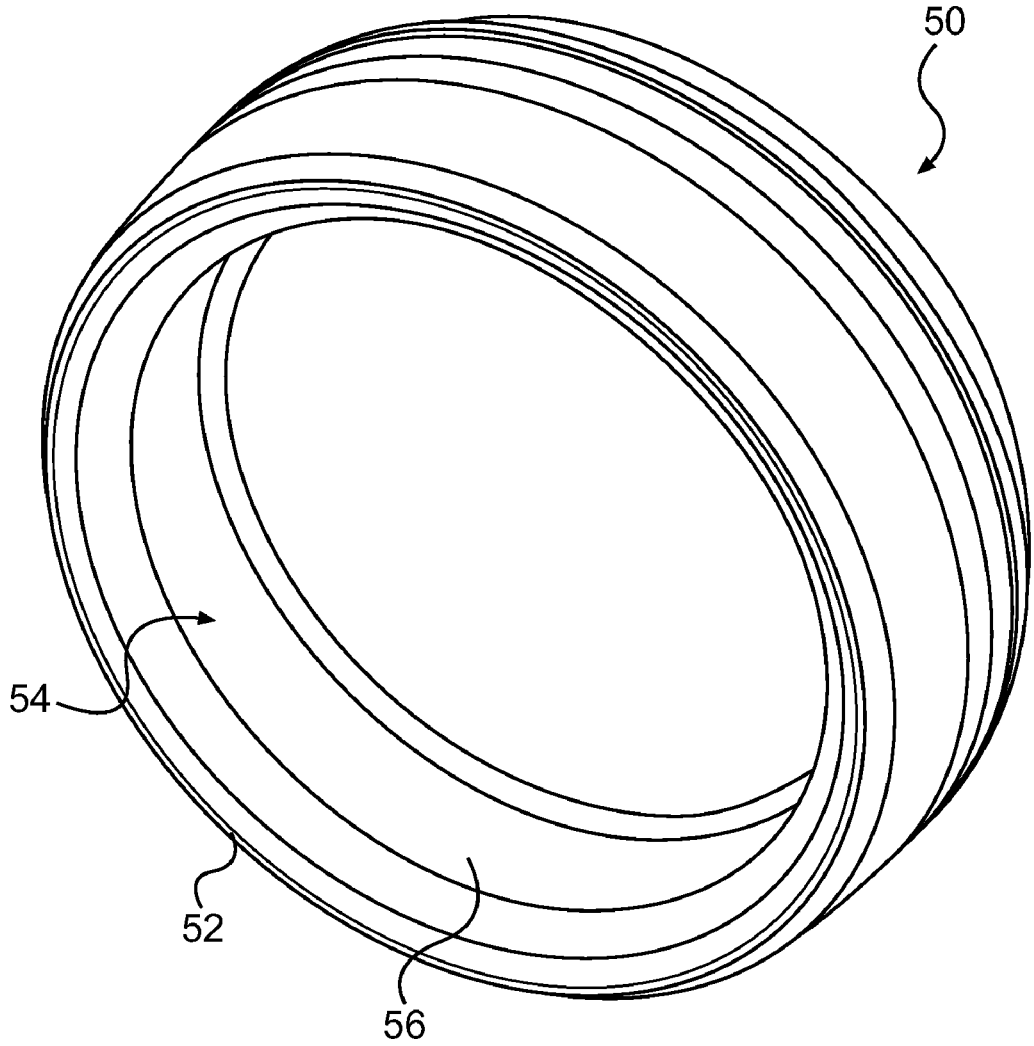
FIG. 5 is a fragmentary perspective view of a container bottom according to one embodiment of the invention.

FIG. 5 depicts a container bottom 50 that is made according to one embodiment of the invention, showing the deep inset base. Container bottom 50 includes a relatively, tall, narrow standing ring 52 and a central push-up area 54 that includes a substantially smooth upstanding container bottom sidewall portion 56.

Figure 2:
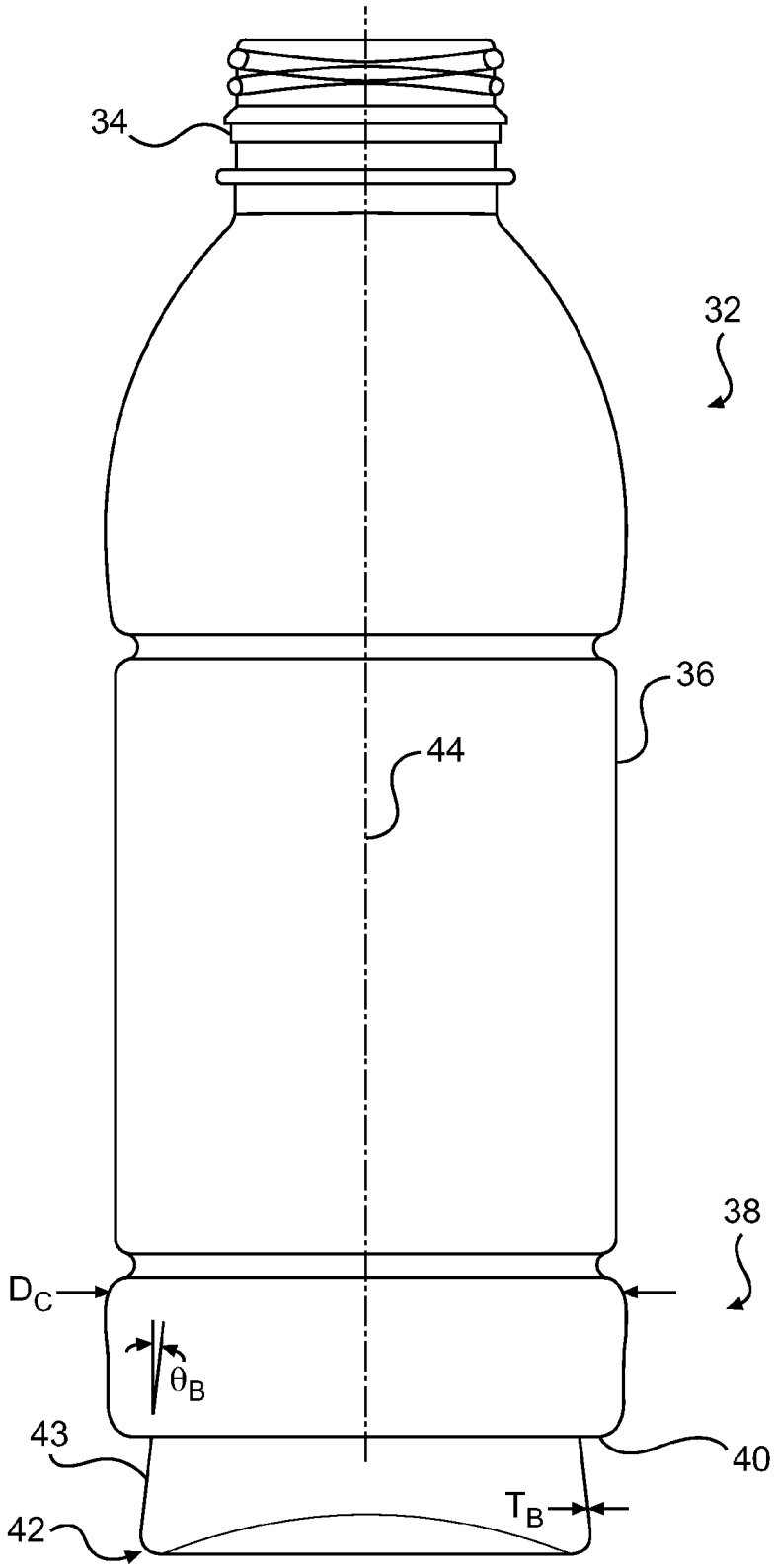
FIG. 2 is a side elevational view depicting an intermediate container blank according to an alternative preferred embodiment of the invention.

A method of making a plastic container according to a preferred embodiment of the invention includes steps of molding a container blank having a standing ring and a base projection portion that is formed beneath the standing ring and relatively displacing the base projection portion upwardly with respect to the standing ring until the base projection portion is positioned above the standing ring. A container blank 32 according to a preferred embodiment of the invention is shown in FIGS. 2 and 3.

Container blank 32 includes a threaded finish portion 34, a main body portion 36 and a container blank bottom 38 that defines a standing ring 40 and a downwardly depending base projection portion 42 that is formed beneath the standing ring 40. The main body portion 36 is preferably although not necessarily formed so as to be substantially symmetrical about a vertical axis 44.

Figure 3:
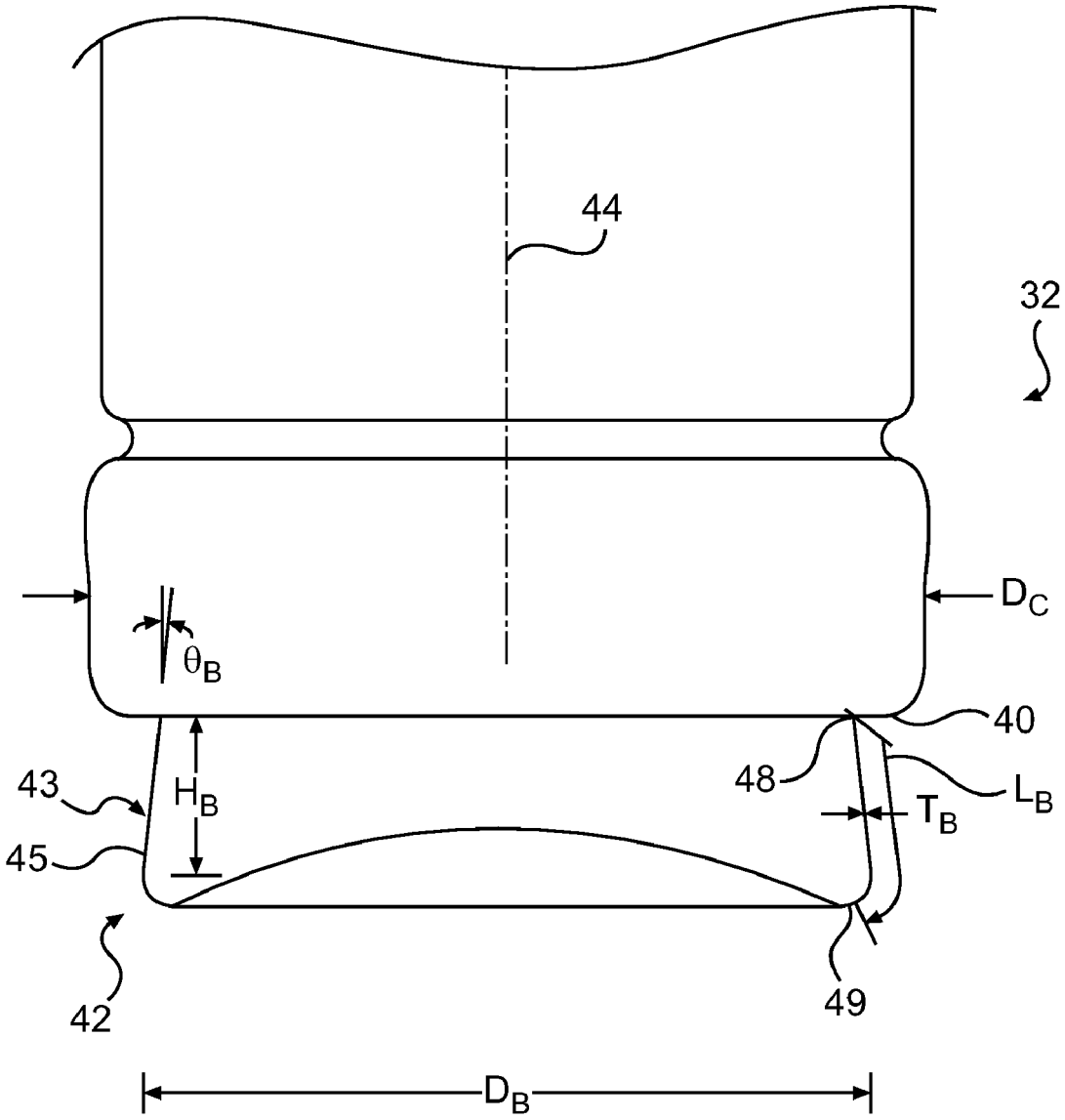
FIG. 3 is an enlarged view of a portion of the article that is depicted in FIG. 2.

As is best shown in FIG. 3, the base projection portion 42 includes an upstanding sidewall portion 43 that in the preferred embodiment forms the upstanding container bottom sidewall portion 22 shown in FIGS. 1 and 4 after the base projection portion 42 is relatively displaced and inverted with respect to the standing ring 40. Upstanding sidewall portion 43 is preferably although not necessarily substantially smooth, and may include a plurality of spaced vertically or longitudinally oriented ribs or grooves that aid in the separation of the base projection portion 42 from the blow mold cavity wall after molding.

The substantially smooth upstanding sidewall portion 43 preferably has an average wall thickness $T_B$ that is preferably within a range of about 0.018 inch to about 0.011 inch, and that is most preferably about 0.014 inch.

Preferably, the plastic container 10 that is made according to embodiment of the invention shown in FIG. 4 has a first maximum diameter $D_C$, and the base projection portion 42 has a second maximum diameter $D_B$, and the second maximum diameter $D_B$ is within a range of about 110% to about 80% of the first maximum diameter $D_C$. Most preferably, the second maximum diameter $D_B$ is about 95% of the first maximum diameter $D_C$.

The substantially smooth upstanding sidewall portion 43 includes a substantially straight portion 45 that in the preferred embodiment is angled downwardly and outwardly with respect to a vertical plane as viewed in vertical or longitudinal cross-section as shown in FIG. 3. The substantially straight portion 45 is preferably symmetrically shaped about a circumference of the base projection portion 42 so as to define a substantially straight annular wall. The substantially straight portion as viewed in vertical or longitudinal cross-section preferably is substantially parallel to a longitudinal axis 44 of the container blank. Substantially parallel in this case is defined as being angled with respect to a vertical plane at an angle $\Theta_B$ that is within a range of about 0° to about 15°.

The substantially straight portion 45 has a height $H_B$ as measured parallel to a longitudinal axis 44 of the container blank that is preferably greater than about 0.3 inch. The substantially smooth upstanding sidewall portion 43 of the base projection portion 42 has a length $L_B$ measured, as is best shown in FIG. 3, along its curvature between a first, upper location 48 and a second, lower location 49. Preferably, the length $L_B$ is within a range of about 100% to about 115% of the height $H_B$.

Preferably, the length $L_B$ is also within a range of about 75% to about 115% of the height $H_S$ of the upstanding container bottom sidewall portion 22.

The inversion or relative displacement of the base projection portion as shown in FIG. 3 into the container bottom shown in FIG. 4 is preferably performed while the plastic material is still formable and stretchable. Accordingly, according to one embodiment of the invention the inversion process may be performed to elongate and stretch the length of the base projection portion so that the height $H_S$ of the container bottom is greater than the height $H_B$ of the base projection portion. The permits the formation of a deep inset base that is deeper than would otherwise be possible, and permits under some circumstances more optimal material distribution with the container base. Accordingly, it permits lightweighting of the container in order to minimize material costs.

Figure 6:
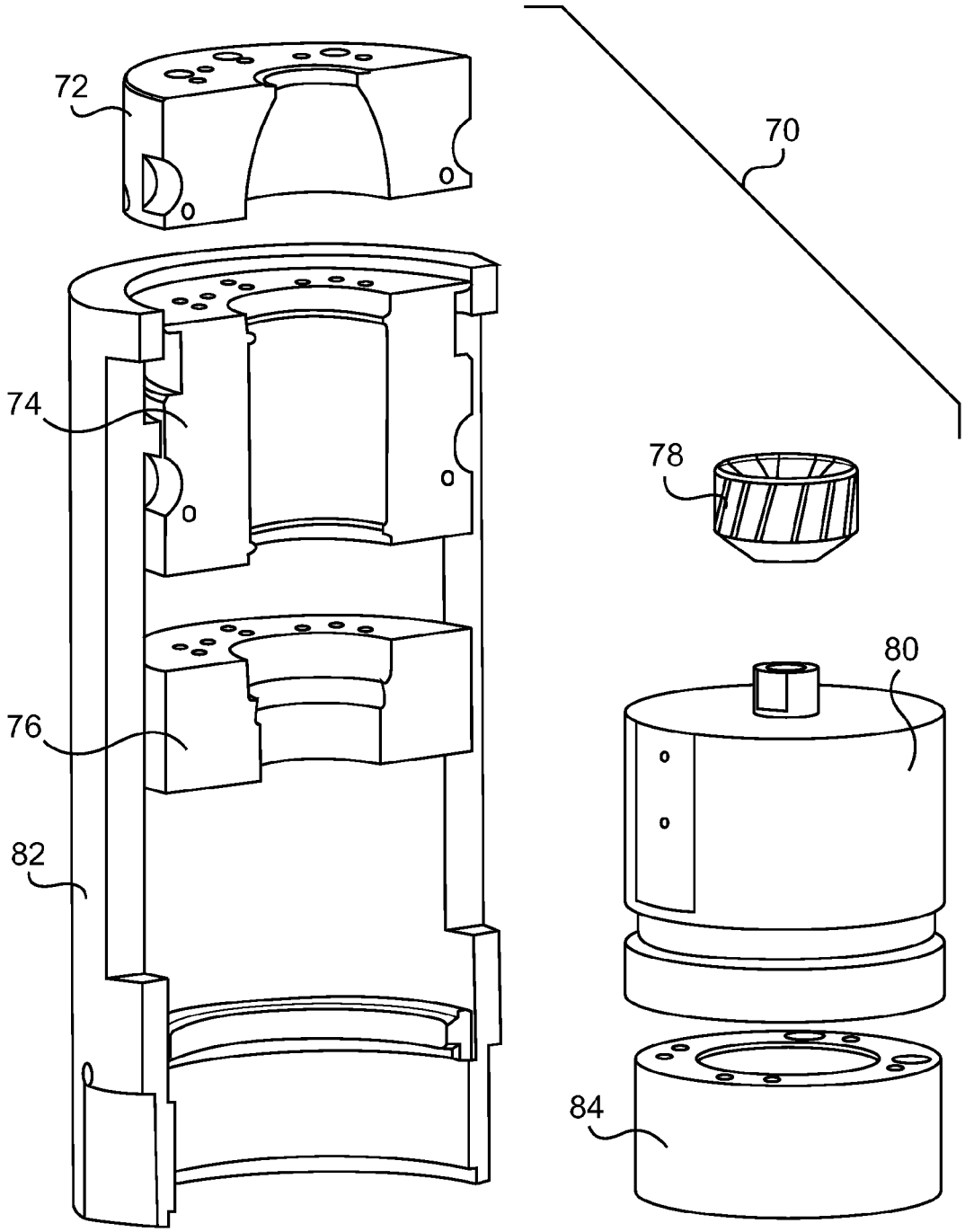
FIG. 6 is an exploded view of a mold assembly that is used to make a container according to a preferred embodiment of the invention.

FIG. 6 depicts a mold assembly 70 that is constructed according to a preferred embodiment of the invention for molding a container blank 32 and then relatively displacing or inverting the base projection portion 42 of the container blank 32 with respect to the standing ring 40 until the base projection portion 42 is positioned above the standing ring 40 in order to complete formation of a container 10.

Mold assembly 70 includes a first mold portion 72 that is shaped to define an upper portion of the main body 36 of the container blank 32. A second mold portion 74 is shaped to define the rest of the main body 36, while a third mold portion 76 is shaped to form portions of the container blank bottom 38 including the base projection portion 42. Actuator 80 is supported by a pedestal 84 that is received within the mold housing 82.

Figure 7:
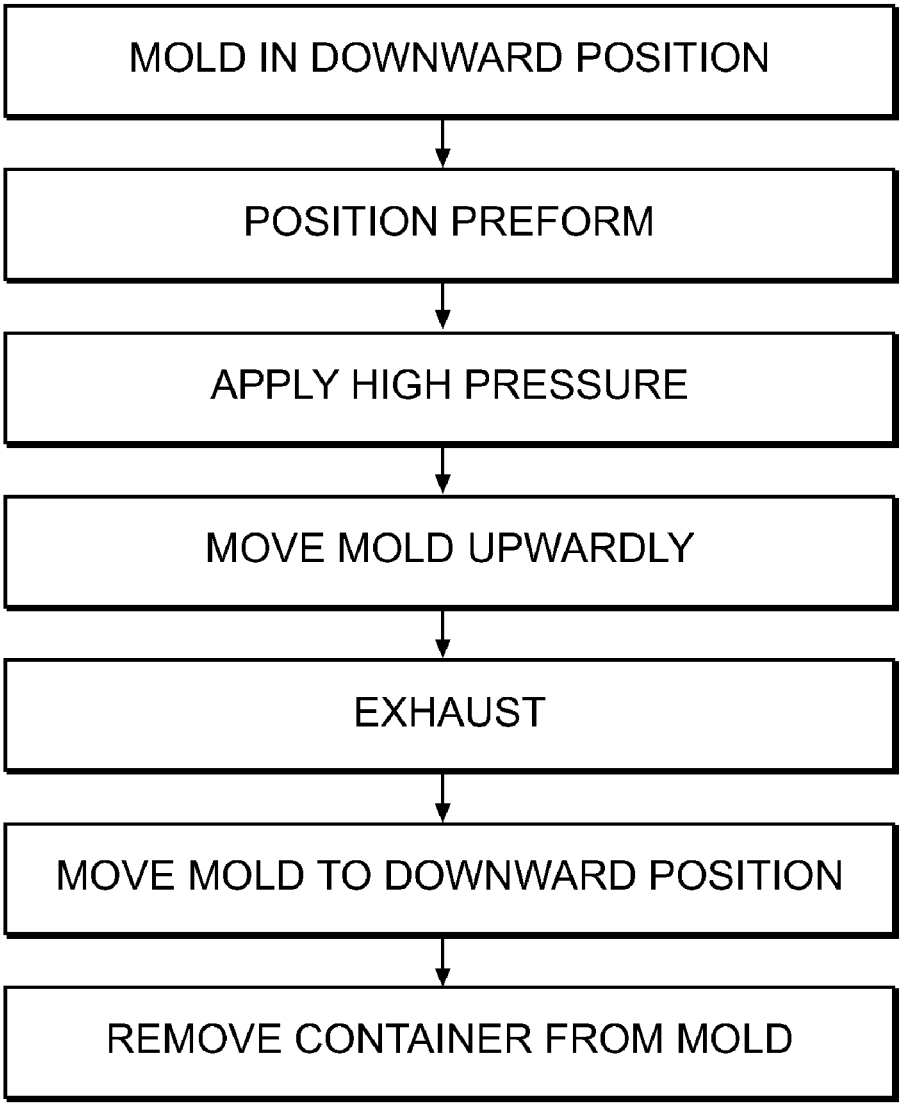
FIG. 7 is a flow chart depicting a method that is performed according to a preferred embodiment of the invention.

FIG. 7 is a flow chart depicting a preferred method for making a container according to one aspect of the invention.

In order to form a container blank 32, a heated plastic preform is positioned within the mold assembly 70 and the mold assembly is locked. The preform is then subjected to a pre-blow process in order to prevent the preform from collapsing on itself and is then longitudinally stretched using a stretch rod in otherwise conventional fashion in order to initiate the well-known reheat stretch blow molding process.

High pressure (typically on the order of 520-600 psi) is then applied to the interior of the preform with the mold surface 78 in the downward position in order to cause the plastic material from the preform to stretch and conform to the mold surfaces that are defined by the various above-described mold portions 72, 74, 76, 78. This forms the container blank 32.

After the container blank 32 has been formed, the actuator 80 will be instructed by a control system to displace the fourth movable mold portion 78 upwardly with respect to the mold portions 72, 74, 76 in order to upwardly displace and invert the base projection portion into its final position above the standing ring of the container. Effectively, the base projection portion 42 is inverted in order to form the deep inset base of the container that is depicted in FIG. 1, 4 or 5. This step is advantageously initiated while the high pressure is still being maintained within the container blank 32, before the pressurized gas is exhausted from the mold assembly.

Preferably, the level of pressurization within the container blank relative to ambient pressure at the time that the fourth movable mold portion 78 is moved upwardly is at least 50% of the maximum pressurization that occurs within the mold during the formation of the container blank 32.

The pressurization within the container blank relative to ambient pressure at the time that the fourth movable mold portion 78 is preferably at least 260 psi, relative to external ambient pressure. This will prevent crushing of the container sidewalls during the upward movement of the fourth movable mold portion 78.

In addition, the upward movement of the fourth movable mold portion 78 is preferably performed before substantial cooling of the base projection portion has occurred, and while the plastic material retains a substantial amount of stretchability and flexibility. Preferably, the upward movement of the fourth movable mold portion 78 takes places within about 10 seconds after the container blank 32 is formed.

As FIG. 7 shows, the stretch rod is retracted and the exhaust process is initiated while the fourth movable mold portion 78 is still in the upper position. The fourth movable mold portion 78 is then lowered, the mold is opened, and the container 10 is removed from the mold.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container, comprising:

a main body portion;

a base portion defining a standing ring and having a deep inset recess defined therein, said deep inset recess being defined in part by an upstanding sidewall portion that is adjacent to said standing ring, said upstanding sidewall portion having a height that is greater than about 0.35 inch, wherein said upstanding sidewall portion has an average wall thickness that is within a range of about 0.018 inch to about 0.011 inch.

2. A plastic container according to claim 1, wherein said upstanding sidewall portion comprises a substantially straight portion as viewed in longitudinal cross-section.

3. A plastic container according to claim 2, wherein said substantially straight portion is angled with respect to a vertical plane that is parallel to a vertical axis of the container at an angle that is preferably within a range of about 0° to about 15° .

4. A plastic container according to claim 2, wherein said substantially straight portion is angled downwardly and outwardly with respect to a vertical plane.

5. A plastic container according to claim 4, wherein said substantially straight portion is symmetrically shaped about a circumference thereof so as to define a substantially straight annular wall.

6. A plastic container according to claim 2, wherein said base portion comprises an outer sidewall having a substantially straight portion, and wherein said substantially straight portion of said upstanding sidewall portion is substantially parallel to said substantially straight portion of said outer sidewall.

7. A plastic container according to claim 1, wherein said upstanding sidewall portion defines an annular sidewall.

8. A plastic container according to claim 1 wherein said average wall thickness is about 0.014 inch.

9. A plastic container according to claim 1, wherein said container is blow molded according to the reheat stretch blow molding process.

10. A plastic container according to claim 1, wherein said upstanding sidewall portion has a surface distance length that is within a range of about 100% to about 115% of said height.

* * * * *